US008973326B2

(12) United States Patent
Lenoci

(10) Patent No.: US 8,973,326 B2
(45) Date of Patent: Mar. 10, 2015

(54) MODULAR FLOOR SYSTEM

(75) Inventor: Stefano Lenoci, San Giovanni Lupatoto (IT)

(73) Assignee: Lenox S.R.L., Citta' di Castello (PG) (IT)

( * ) Notice: Subject to any disclaimer, the term of this patent is extended or adjusted under 35 U.S.C. 154(b) by 0 days.

(21) Appl. No.: 13/144,021

(22) PCT Filed: Jan. 12, 2010

(86) PCT No.: PCT/IB2010/050098

§ 371 (c)(1),
(2), (4) Date: Aug. 24, 2011

(87) PCT Pub. No.: WO2010/079462

PCT Pub. Date: Jul. 15, 2010

(65) Prior Publication Data

US 2011/0289875 A1 Dec. 1, 2011

(30) Foreign Application Priority Data

Jan. 12, 2009 (IT) ..... PG2009A0001

(51) Int. Cl.
*E04F 13/08* (2006.01)
*E04F 15/02* (2006.01)
*E04F 15/022* (2006.01)

(52) U.S. Cl.
CPC ..... *E04F 15/02* (2013.01); *E04F 15/022* (2013.01)
USPC ..... 52/384

(58) Field of Classification Search
CPC ... E04F 15/02; E04F 15/147; E04F 15/02022; E04F 15/02044; E04F 15/02133; E04F 15/02183; E04F 15/02194; E04F 15/022; E04F 15/041; E04F 15/043; E04F 15/048; E04F 15/06; E04F 15/08; E04F 15/082; E04F 15/087; E04F 15/10; E04F 15/105; E04F 15/16; E04F 15/163; E04F 15/166; E04F 13/0801; E04F 13/0803; E04F 13/0812; E04F 13/0814; E04F 13/0821; E04F 13/0823; E04F 13/0826; E04F 13/0832; E04F 13/0841; E04F 13/0846; E04F 13/0862; E04F 2201/0192; E04F 2201/01; E04F 2201/0115; E04F 2201/013; E04F 2201/0146; E04F 2201/0161; E04F 2201/0176
USPC ..... 52/578, 586.1, 586.2, 476, 480, 489.2, 52/372, 371, 375, 384, 386, 387, 390, 392, 52/177, 180, 181, 408, 126.1, 126.5, 52/126.6; 404/37, 38, 39, 40, 41
See application file for complete search history.

(56) References Cited

U.S. PATENT DOCUMENTS 4,987,712 A * 1/1991 Mancuso ..... 52/387
5,006,011 A * 4/1991 Hiyashi ..... 404/37

(Continued)

FOREIGN PATENT DOCUMENTS

DE 203 00 661 U1 8/2003
EP 1 717 386 A2 11/2006

OTHER PUBLICATIONS

International Search Report, dated Jun. 23, 2010, from corresponding PCT application.

*Primary Examiner* — Jessica Laux
(74) *Attorney, Agent, or Firm* — Young & Thompson

(57) ABSTRACT

A modular fitted flooring system includes a plurality of bearing plates (2) and a plurality of panel elements (3) designed to be hooked onto the bearing plates (2), the bearing plates including a plurality of supporting elements (7), a panel hooking element (13), and elements (14) for bearing the load of the panel elements, and being complete with jointing elements (20, 21) for connecting one bearing plate (2) to the next, the panel hooking element (13) consisting of a plurality of teeth designed to engage in grooves (17) provided on at least two edges of the panel element (3), the teeth (13) being arranged on the plate so as to create a gap between one panel element and the next in a direction (Y) crosswise to the direction of installation (X) of the panel elements.

13 Claims, 12 Drawing Sheets

(56) References Cited

U.S. PATENT DOCUMENTS

| | | | | |
|---|---|---|---|---|
| 6,374,563 | B1 * | 4/2002 | Erskine et al. | 52/506.03 |
| 7,341,401 | B2 * | 3/2008 | Blackwood | 405/36 |
| 2003/0009973 | A1 * | 1/2003 | Lee | 52/589.1 |
| 2003/0136070 | A1 | 7/2003 | Ku | |
| 2003/0177728 | A1 * | 9/2003 | Ku | 52/403.1 |
| 2005/0034403 | A1 | 2/2005 | Chen | |
| 2008/0222973 | A1 * | 9/2008 | Lee et al. | 52/126.1 |

* cited by examiner

MODULAR FLOOR SYSTEM

BACKGROUND OF THE INVENTION

1. Field of the Invention

The present invention relates to a system for fitted floors, and in particular for flooring consisting of wooden panels, comprising a number of interlocking modular bearing plates to which a plurality of panel elements can be fixed to cover outdoor surfaces such as terraces, patios, swimming pool borders and the like.

2. Description of the Related Art

This type of flooring is currently made using conventional methods that, in the majority of cases, involve the assembly and the subsequent processing in situ of the various flooring components.

An example of the flooring of the known art is shown in figures from 14*a* to 14*c*. With reference to these figures, said flooring comprises a number of supporting elements 101, generally arranged equidistantly over the whole surface area to be covered with flooring, that serve the purpose of supporting the flooring, which is constructed thereon, and of separating it from the subfloor.

A number of beam members 102, made of wood or metal, arranged in parallel rows at a preset distance (generally in the range of 40 to 80 cm) are attached to the supporting elements by means of screws or similar means, as shown in FIG. 14*a*.

The wooden panels 103 that constitute the flooring surface are then attached to this framework; in particular, said panels are installed in a direction perpendicular to that of the beam members 102, as shown in FIG. 14*b*.

Clips 104 are used to attach said panels 103 to the beam members 102, said clips being fixed to the beam members by means of screws or the like.

More in detail, said clips have an omega-shaped profile with two ends 105 suitable for engaging in grooves 106 provided along the edges of the panels 103 in order to retain the panels in a fixed position and separated from one other, as shown in FIG. 14*c*.

The gap between one panel and the next is essential not only to allow for water to run off into the space underneath (onto the subfloor), but also and above all to enable the panels to expand and contract as a result of variations in humidity and temperature.

Alternatively, the flooring panels may be attached directly to the beam members by means of screws but, in this case, in order to allow for their expansion, the panels must undergo a preliminary perforation to create a special recess for containing the screws.

In addition, with this system the gap between one panel and the next must be achieved manually by inserting shims or the like between two adjacent panels.

Said known types of flooring have a number of drawbacks, however.

In fact, the above-mentioned steps needed to construct the flooring in situ are rather time-consuming and demand the use of special equipment; and for the floor to be properly installed, they need to be done by skilled and experienced personnel.

Moreover, the flooring thus configured consists of a large number of components (supporting elements, different types of screw, beam members, panels, clips, etc) that prevent any standardisation of the production process.

All these characteristics mean that this type of flooring has always been too expensive to be used on a large scale and it has consequently remained a product for a niche market.

Another disadvantage of these systems relates to the quality of the flooring, and particularly to its stability and durability.

In fact, the supporting elements 101 and the beam members 102 are placed, as mentioned previously, a certain distance apart, that is generally between approximately 40 cm and 80 cm.

The panels 103 that are installed on top of said beam members are consequently supported not over their whole length, but only in certain places (coinciding with the supporting elements 101) where the bending strains become concentrated.

As a result, the static loads that can be brought to bear, for instance, by the weight of objects resting permanently on the floor (such as plant pots, furniture, etc) and the dynamic loads deriving from usage induces a gradual deflection of the panels. Because of these deflections, the surface of the flooring is no longer perfectly aligned, giving rise to an unattractive aesthetic effect as well as to practical problems (e.g. the risk of tripping, problems with supporting furniture, etc).

In addition, this continuous bending in line with the places where the panels are fixed can lead to cracking that, with time they damage the panels completely. Another problem that occurs with systems of this type concerns the installation of the flooring on surfaces that are not perfectly level and horizontal.

In such cases, it becomes necessary to manually add shims to some of the supporting elements in order to make sure that all the supporting elements 101 actually provide support for the beam members and panels, and this takes more time.

Some supporting elements allow for their height off the subfloor to be adjusted but, here again, levelling the various supporting elements takes a considerable amount of time.

There are also other types of paneled flooring for outdoor installations available on the market, that differ slightly from those described above.

Some, for instance, have rapid couplings for the panels instead of the classic clips, that enable the panels to be snap-fastened in place under pressure.

In this case, the assembly of the panel element is facilitated somewhat, but the drawbacks relating to the preparation of the supporting framework (supporting elements, beam members, etc) remain and so do the problems relating to the fact that the panels are supported not over their full length, but only on certain places, where the bending strains become concentrated.

BRIEF SUMMARY OF THE INVENTION

In the light of, the above considerations, the object of the present invention is a modular fitted flooring system, particularly for wood paneled flooring, that overcomes the above-described drawbacks of the known art.

In particular, one object of the invention is a modular fitted flooring system that provides a stable and solid base for the flooring, enabling a uniform distribution of the loads on the panel elements in order to contain their deformation, and that is quick and easy to install thanks to its modular design.

Another object of the present invention is a modular fitted flooring system, particularly for wood panel flooring, with a panel fixing system that enables a rapid and efficient water run-off from the flooring surface and that allows for the panel elements to expand and contract as a result of variations in humidity and temperature.

Another object of the present invention is a modular fitted flooring system, particularly for wood panel flooring, that is suitable for manufacturing in standardised form to contain the production costs, but that also allows for the creation of different installation patterns (e.g. in strips with the joints randomly-staggered or alternating, in square basket patterns, etc).

The above-stated objects are substantially achieved by a modular fitted flooring system comprising a plurality of bearing plates and a plurality of panel elements designed to be hooked onto said bearing plates, said bearing plates comprising a flat plate with a lower surface having a plurality of supporting elements that provide the base for resting the plate on a subfloor, and an upper surface with panel hooking means and load-bearing elements, the lateral edges of said plates including jointing elements for connecting one bearing plate to another adjacent thereto, characterised in that said panel hooking means consist of a plurality of teeth extending from said upper surface of the bearing plate and designed to engage in grooves provided on at least two edges of the panel element, said teeth being arranged on the bearing plate so as to create a gap between one panel element and another adjacent thereto in a direction crosswise to the direction of installation of the panel elements.

This makes it possible to achieve a solid, stable modular fitted flooring system that is quick and easy to install, thanks to the modular system of bearing plates and to the panel hooking means, which enable the panel elements to be installed simply under pressure, without needing to use particular equipment or specialised personnel.

In particular, the teeth are arranged in parallel rows located respectively along the lateral edges of each panel element so as to create a gap between one panel element and the next.

The teeth are thus free to bend during the installation of the panel element and following any expansion of the panel element as a result of variations in humidity and temperature, in addition to enabling the run-off of water from the floor surface. In addition, said bearing plate supporting elements can be designed to have a height that is constant or that increases progressively from one side towards the opposite side so as to create a supporting surface sloping at a given angle in relation to the bearing plate.

This solution ensures that the installed flooring is always perfectly flat irrespective of any sloping of the subfloor.

BRIEF DESCRIPTION OF THE DRAWINGS

Further characteristics and advantages will emerge more clearly from the following non-limiting description of a preferred, but not exclusive embodiment of the invention, as shown in the attached figures, wherein.

DETAILED DESCRIPTION OF THE PREFERRED EMBODIMENTS

Figure 1:
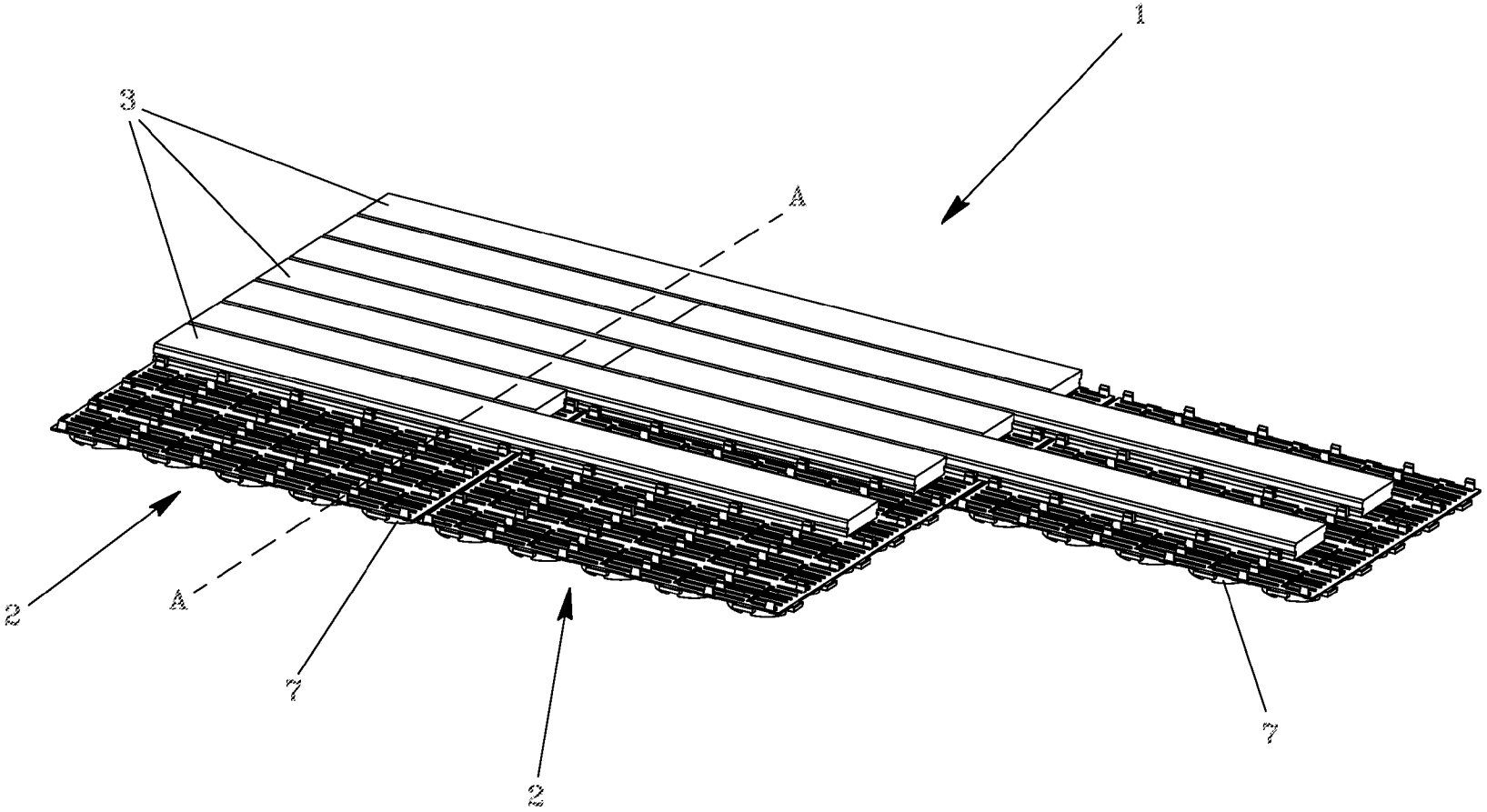
FIG. 1 is a perspective view of the modular fitted flooring system according to the invention.
Figure 2:
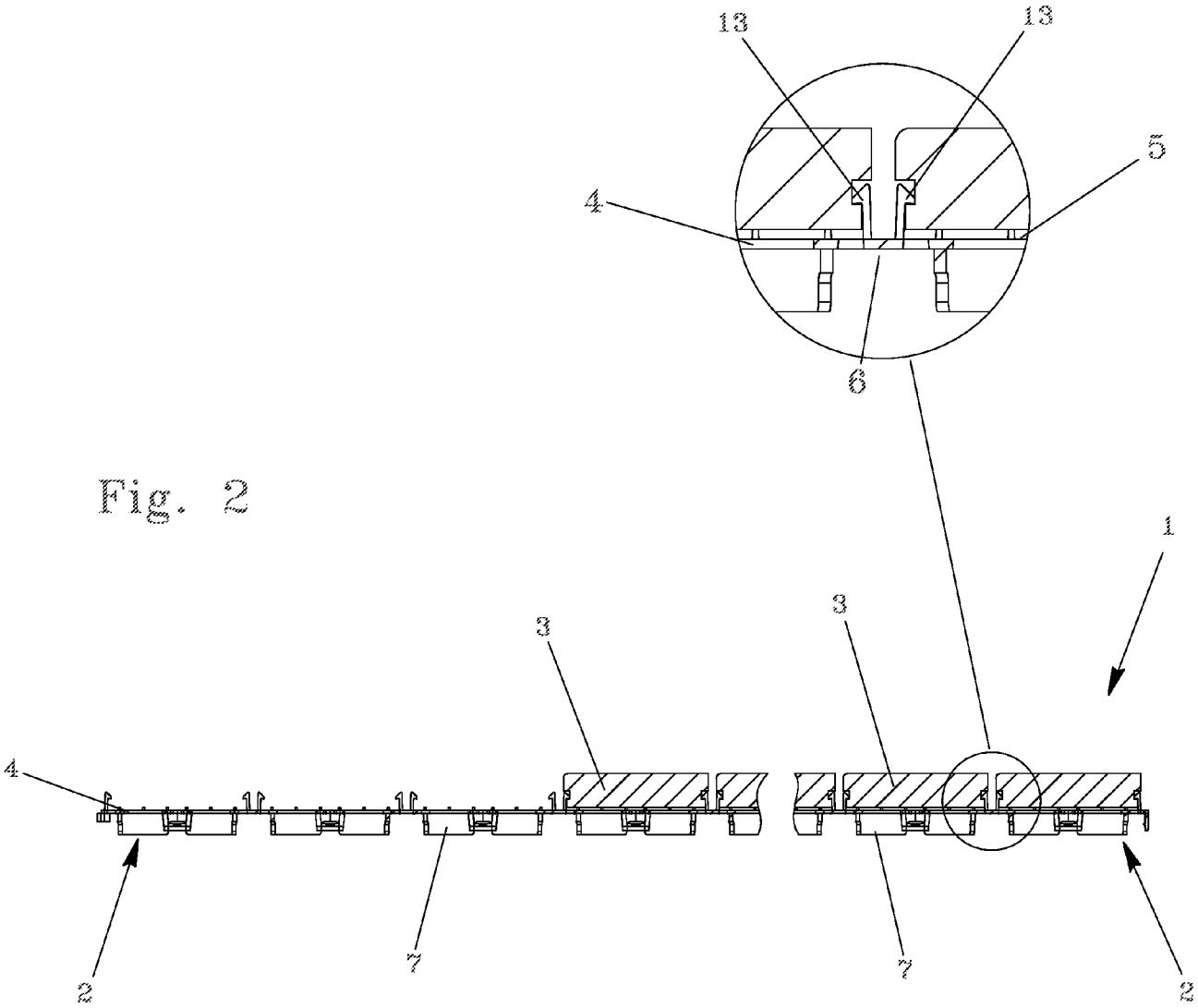
FIG. 2 is a lateral cross-sectional view along A-A of the modular fitted flooring system of FIG. 1.

With reference to the attached FIGS. 1 and 2, the modular fitted flooring system globally indicated by the numeral 1 comprises a plurality of bearing plates 2 joined together to form a supporting surface and a plurality of panel elements 3 fixed to said bearing plates 2 to form the flooring surface.

Said bearing plates are preferably made of a plastic material, e.g. nylon, polyethylene, polypropylene or the like, by injection moulding or similar procedures.

This characteristic enables a supporting surface to be obtained with a good mechanical strength for bearing the static and dynamic loads coming to bear on the flooring, while at the same time it guarantees sufficient flexibility to ensure that the supporting surface can adhere to and follow the surface of the subfloor perfectly.

The various bearing plates 2 are connected together by means of suitable joints located on the lateral edges that enable a supporting surface of the required shape and size to be created within an installation time that is reduced to a minimum.

Each bearing plate 2 in turn comprises a flat plate, indicated by the numeral 4, with an upper surface 5 and a lower surface 6.

On said lower surface 6, there is a plurality of supporting elements 7 that constitute the base on which the plate rests on the subfloor.

In detail, said supporting elements may be of various shape and size providing they are distributed evenly over the lower surface 6 so as to provide a solid and stable supporting surface for the plate 4.

Figure 3:
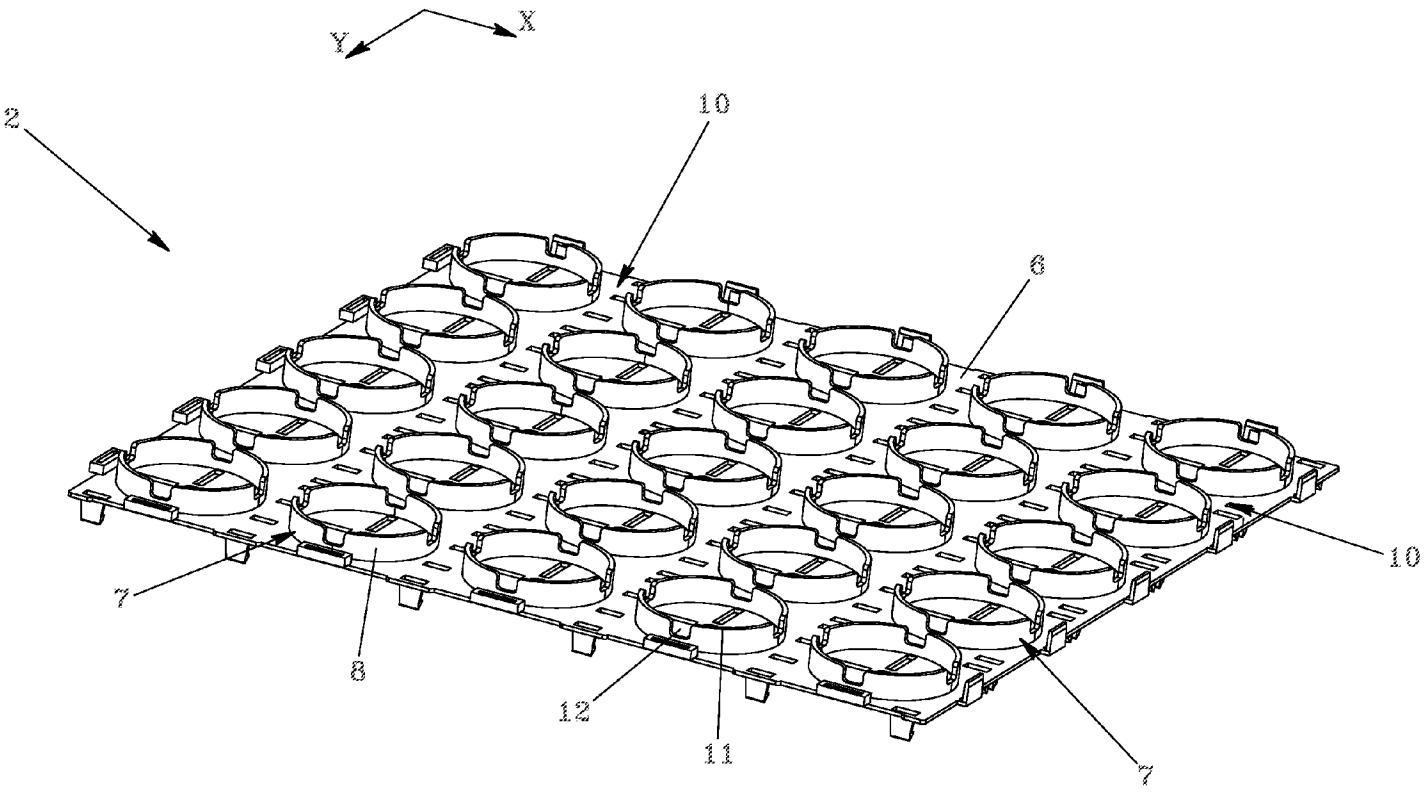
FIG. 3 is a perspective view from below of a bearing plate for the modular fitted flooring system of FIG. 1.
Figure 4:
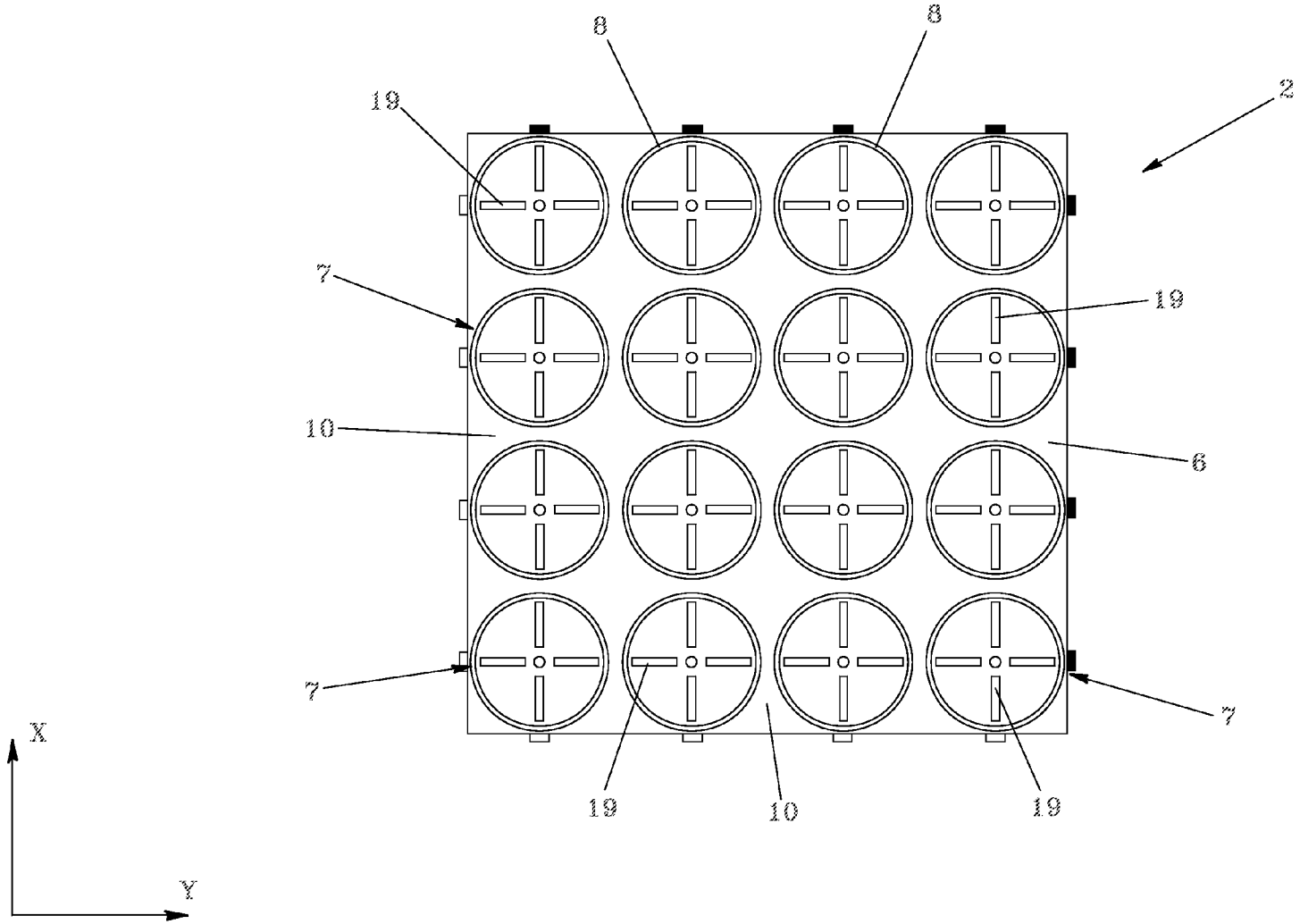
FIG. 4 is a plan view from below of a bearing plate for the modular fitted flooring system of FIG. 1.

With reference to FIGS. 3 and 4, said supporting elements 7 preferably consist of cylindrical surfaces 8 extending from the surface 6, in which further reinforcement ribbing (not shown in the figure) may be incorporated.

The extent of said supporting elements 7 (i.e. of the cylindrical surfaces 8 and of any ribbing) may be chosen at will, but it generally comes preferably in the range of 15 cm to 40 cm.

In fact, the purpose of the supporting elements 7, in addition to supporting the plate 4, is also to provide a gap between said plate and the surface of the subfloor to allow for the run-off of water draining from the surface of the floor and also of any water already on the subfloor.

For this purpose, the supporting elements 7 are arranged over the surface 6 so as to create a series of passages 10 between one element and the next, to allow for the run-off of water towards the water collection and drainage systems.

The cylindrical surfaces 8 also advantageously have the edge on which they rest 11 shaped so that only a part of it is in contact with the subfloor, leaving a plurality of passages 12 for water run-off.

The space between the subfloor and the plate 4 can also be used for the passage of piping or electric wiring, which thus remains completely out of sight, for a pleasing aesthetic effect.

Figure 5:
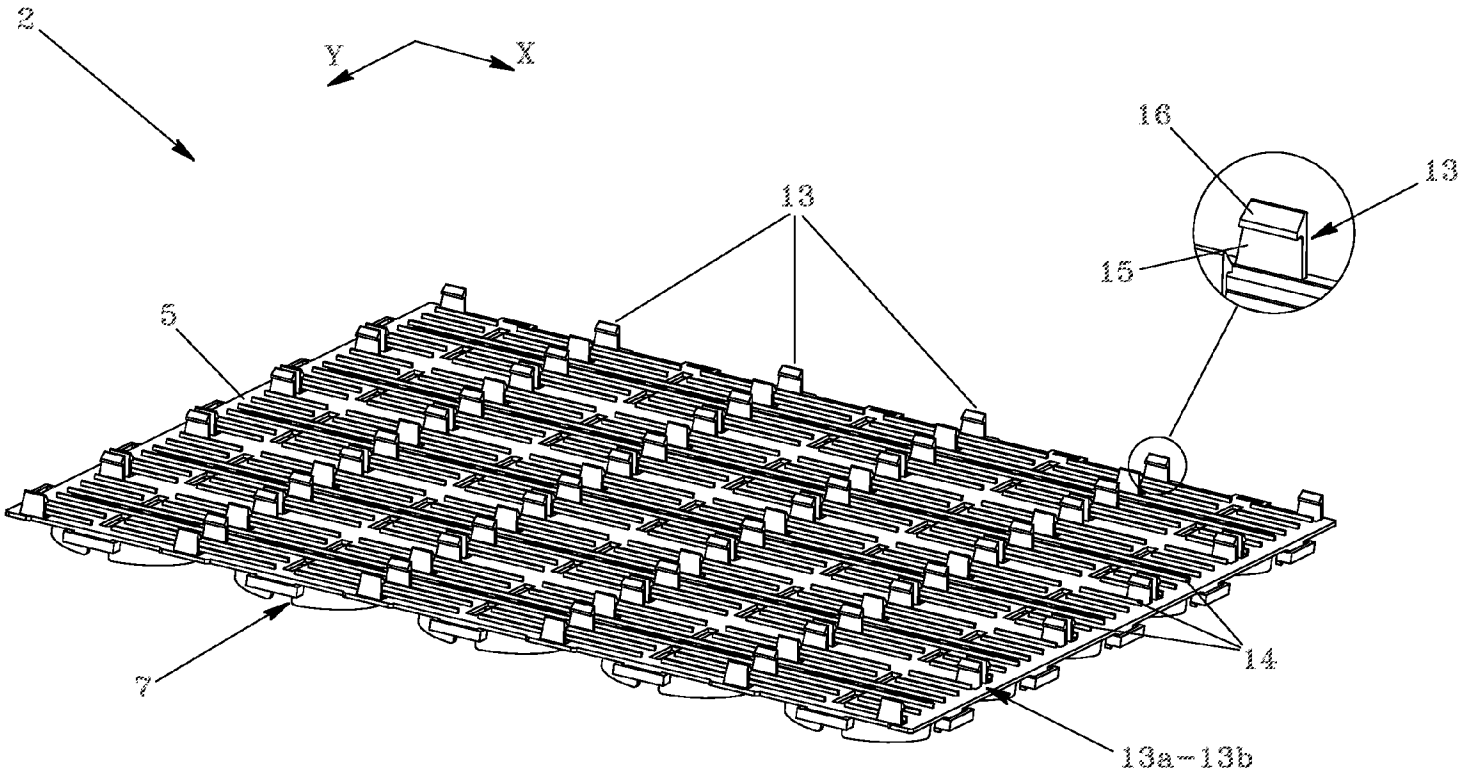
FIG. 5 is a perspective view from above of a bearing plate for the modular fitted flooring system of FIG. 1.
Figure 6:
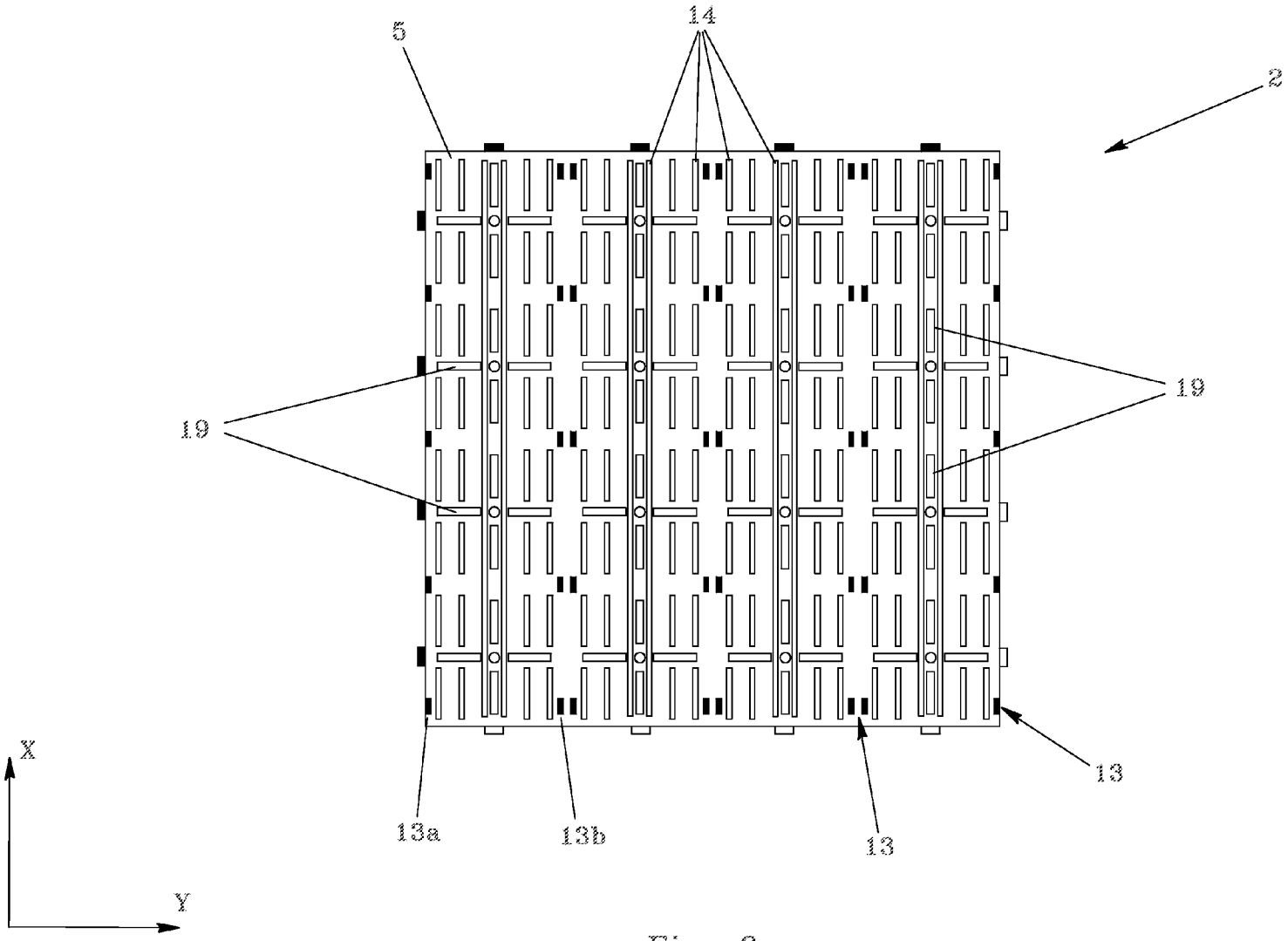
FIG. 6 is a plan view from above of a bearing plate for the modular fitted flooring system of FIG. 1.

With reference to FIGS. 5 and 6, on the upper surface 5 of the plate 4 there is a plurality of means for hooking to the panel elements 3, indicated by the numeral 13, that enable a rapid hooking of the panels under the effect of pressure, and a plurality of load-bearing elements for said panels, indicated by the numeral 14.

In detail, said hooking means consist of a plurality of teeth 13 extending from said upper surface 5, each comprising a supporting stem 15 extending from the upper surface 5 and integral therewith, and a coupling clip 16 located at the end of said supporting stem.

Said hooking means 13 are arranged on the upper surface 5 of the plate 4 in parallel rows in the direction of installation of the panel elements 3, as shown by the letter X in FIGS. 5 and 6.

In particular, each panel element 3 is retained by two rows of teeth 13 located along its lateral edges in the direction X.

Figure 7:
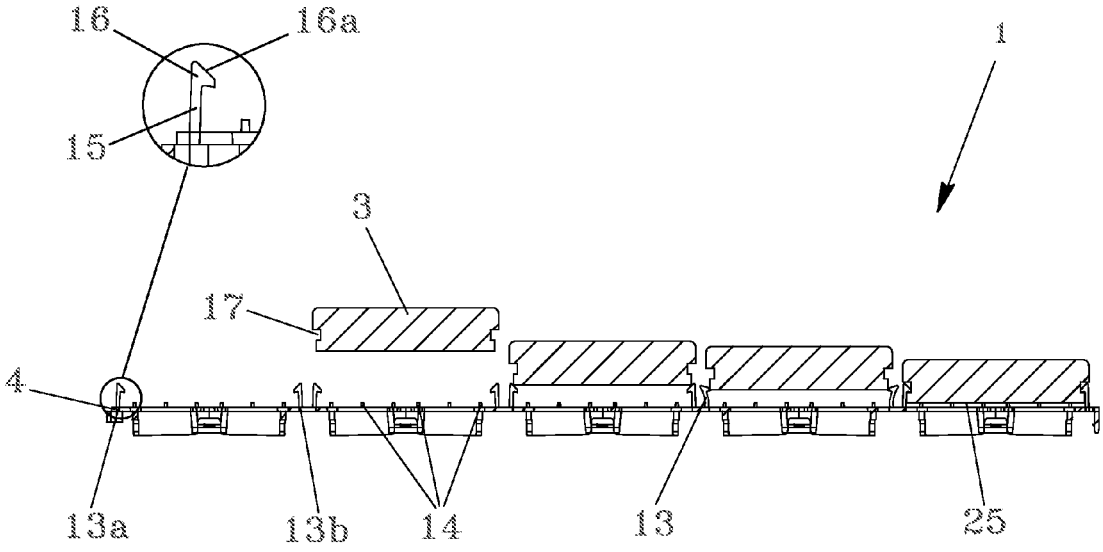
FIG. 7 is a lateral cross-sectional view of the modular fitted flooring system showing the panel hooking steps.

FIG. 7 shows the system for hooking the panel elements 3 onto the bearing plate 2.

As mentioned previously, each panel element 3 is retained by two rows of hooking means, identified in the figure as 13*a* and 13*b*, along the lateral edges 3*a* and 3*b* of the panel element 3.

Figure 8:
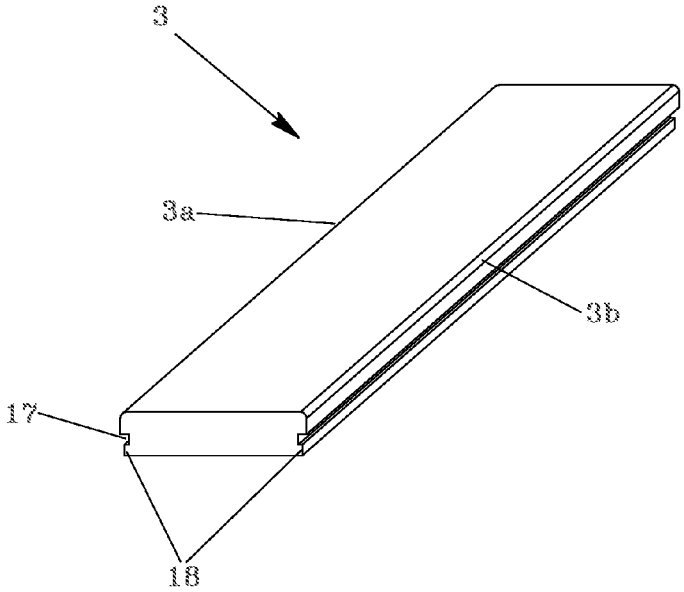
FIG. 8 is a perspective view of a panel element for the modular fitted flooring system of FIG. 1.

The panel element is locked onto the bearing plate 2 thanks to the shaping of the coupling clip 16, designed to engage in a groove 17 provided along the lateral edges of the panels in the direction X, as shown in FIG. 8.

Said clip 16 preferably has a profile with a substantially trapezoid shape tapering upwards so as to define a sloping wall 16*a* on which the panel element slides when it is inserted.

The panel element 3 is also advantageously shaped so that the corresponding lower edges 18 are slightly recessed with respect to the lateral edges 3*a* and 3*b*, so as to co-operate with the walls 16*a* of the clips 16 to facilitate the insertion of the panel element (FIG. 8).

The dimensions and the materials of the hooking means are chosen so as to enable the teeth to bend without the risk of breaking during the insertion of the panel elements (FIG. 7).

The rows of hooking means 13*a* and 13*b* are located so as to leave a gap of several millimeters (approximately 3-5 mm) between one panel element and the next in a direction Y crosswise to that of installation X.

This gap is indispensable both during the installation of the flooring, so that the hooking means 13 can bend during the insertion of the panel element, and also during the use of the flooring, to allow for the run-off of rainwater, for instance, or of washing water, from the floor surface onto the upper surface 5 of the plate 4 underneath, and from there onto the subfloor below.

For this purpose, the invention advantageously includes a plurality of through openings 19 provided on the plate 4 that place the space between the plate 4 and the panel elements in communication with the space underneath, between the plate 4 and the subfloor, as shown in FIGS. 5 and 6.

The water thus runs off the floor surface between adjacent panel elements onto the upper surface 5 of the plate 4, and from there through said openings 19 onto the subfloor, from where it runs into the water collection and drainage systems.

Said openings can be in various shapes providing they are equally distributed over the whole surface of the plate 4 to ensure the maximum water run-off efficiency. Again with reference to FIGS. 5 and 6, the elements that bear the load of the panel elements 3 comprise a plurality of ribs 14 extending from the upper surface 5 of the plate 4 and lying parallel to one another in the direction of installation X of the panel elements 3.

Said load-bearing elements enable the panel element 3 to be separated from the upper surface 5 of the plate 4 while simultaneously providing support for said panel element substantially over its whole length.

As explained previously, the space between the lower surface of the panel element and the plate 4 is indispensable to enable rain water to drain into the space between the plate 4 and the panel elements, and from there into the space underneath, between the plate 4 and the subfloor.

The dimensions of the ribbing 14, the teeth 13 and the profile of the panel elements 3 are calculated so that, when the panel element 3 is hooked in place, its underside remains pressed against the ribbing 14 by the teeth 13 to avoid any slack that, with time, could damage the flooring.

Moreover, thanks to the arrangement of the rows 13*a* and 13*b* of teeth 13, that leave a gap between one panel element and the next, said panel elements can expand and contract as a result of variations in humidity and temperature, exploiting the elasticity of the teeth 13.

As mentioned previously, there are male-female jointing elements on the lateral edges of each bearing plate 2 for joining adjacent bearing plates together to form an integral supporting surface.

Figure 9A:
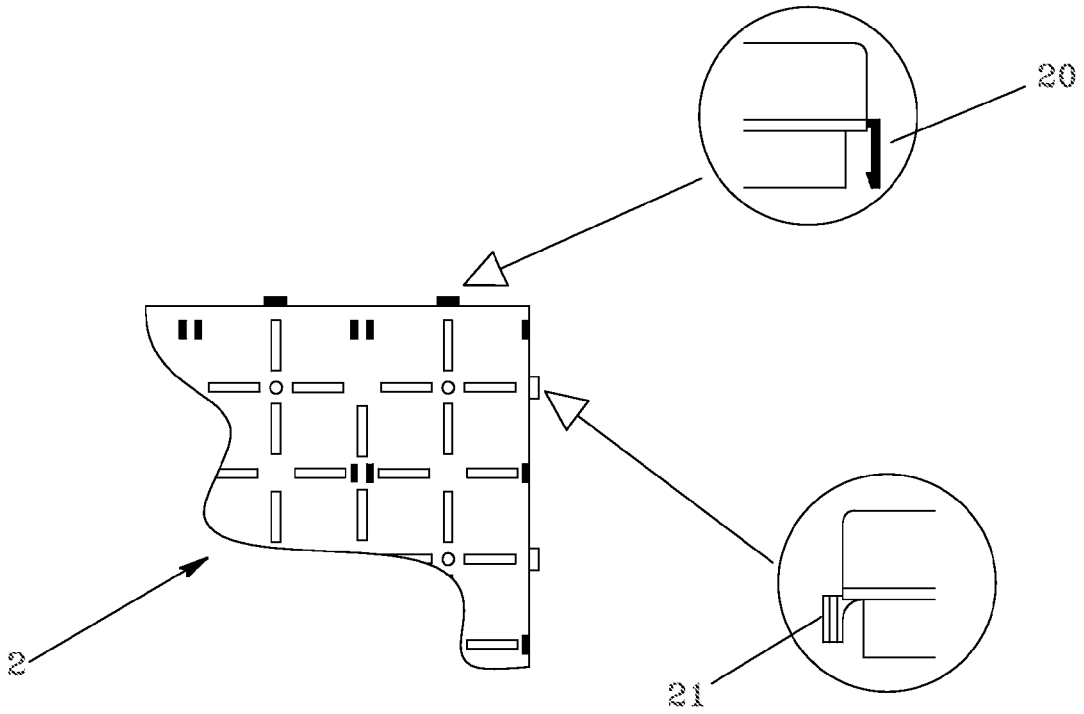
FIGS. 9*a* and 9*b* are two views of a detail of the bearing plate for the modular fitted flooring system of FIG. 1.
Figure 9B:
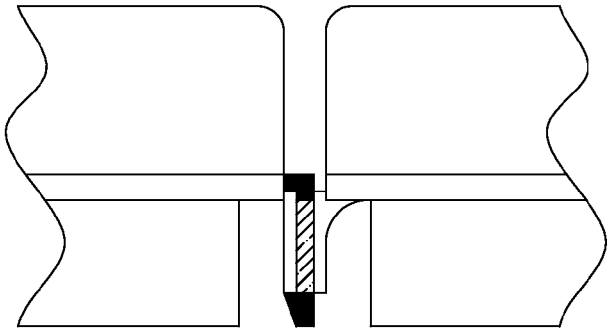

In detail, there is a plurality of male jointing elements 20 on two adjacent lateral edges, while there is a like number of female jointing elements 21 on the other two lateral edges, as shown in FIGS. 9*a* and 9*b*.

According to another embodiment, the bearing plate 2 comprises further hooking means for the panel elements 3 in order to fix them more firmly in the event of particularly demanding conditions of use of the flooring.

Figure 10:
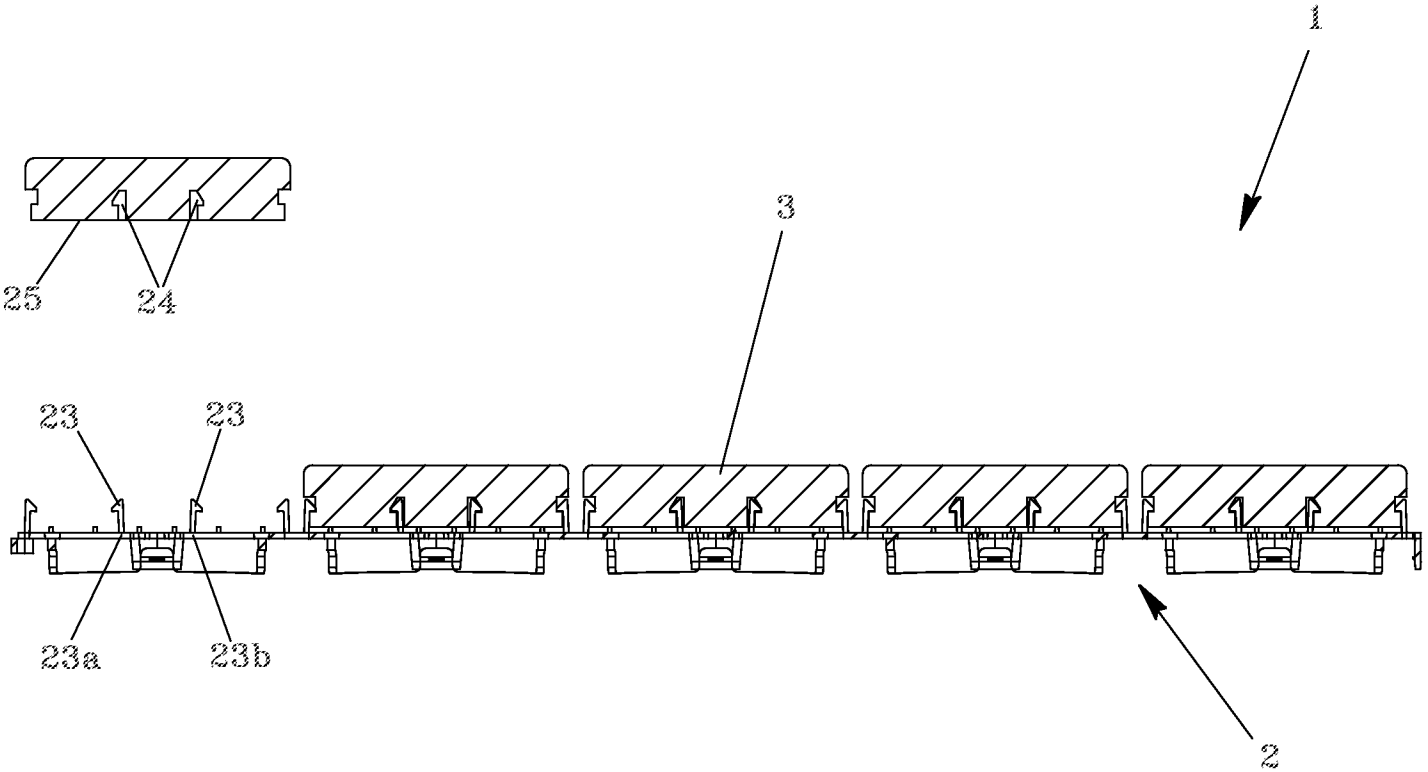
FIG. 10 is a lateral cross-sectional view of the modular fitted flooring system according to another embodiment.

In detail, said further hooking means comprise teeth 23 substantially identical to the teeth 13, designed to engage in grooves 24 provided for said purpose on the underside 25 of the panel element 3, as shown in FIG. 10.

Said teeth 23, like the teeth 13, are arranged in two rows 23*a* and 23*b* lying in the direction of installation X of the panel elements and inserted in between the rows 13*a* and 13*b*.

Figure 11:
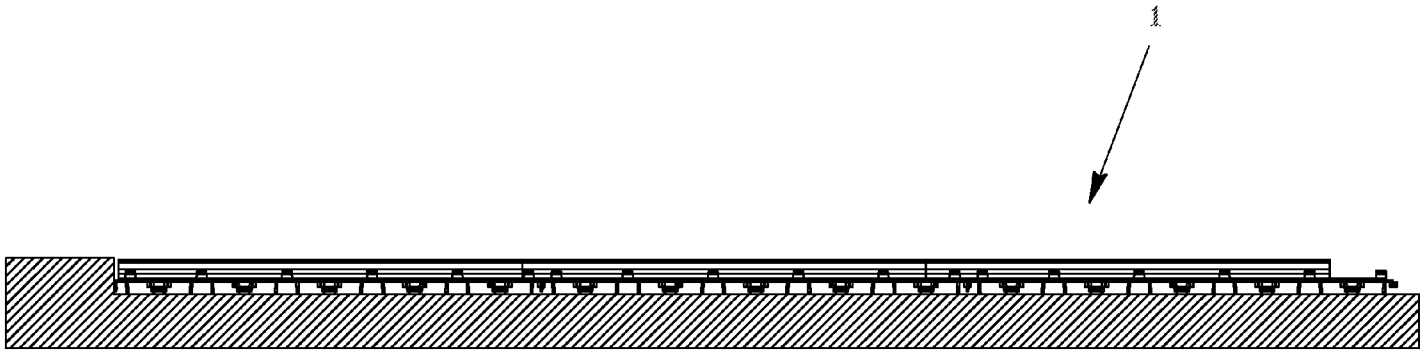
FIG. 11 is a lateral cross-sectional view showing the modular fitted flooring system installed on a subfloor.

The installation of flooring using the modular fitted flooring system according to the invention is extremely quick and easy, giving rise to a flooring such as the one shown in FIG. 11.

After preparing (levelling, cleaning, etc) the subfloor, the various bearing plates 2 are placed in position and joined together by means of the jointing elements 20 and 21, until the whole surface requiring flooring has been covered.

Then the panel elements 3, made of any material chosen by the customer (various types of wood, particle board, plywood, plastic materials, etc) are installed, hooking them onto the bearing plates 2 by exerting a vertical pressure such that the teeth 13 (and possibly also the teeth 23) bend and the clips 16 engage in the grooves 17 provided on the lateral edges of the panel elements 3 (and possibly also in the grooves 24).

Figure 12A:
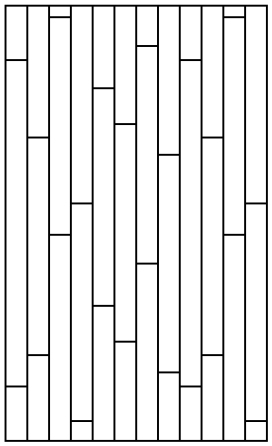
FIGS. 12*a* to 12*d* are four plan views showing various flooring installation patterns.
Figure 12B:
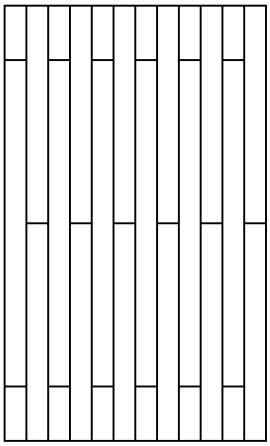
Figure 12C:
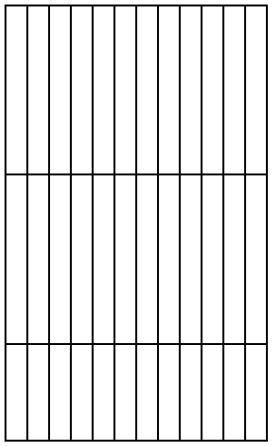

The presence of the jointing elements thus configured and located allows for different installation patterns to be obtained, as shown in figures from 12*a* to 12*d*. For instance, arranging all the bearing plates 2 with the rows 13*a* and 13*b* of teeth 13 aligned in the same direction enables an installation of the strips with randomly-staggered joints (FIG. 12*a*), alternate joints (FIG. 12*b*), aligned joints (FIG. 12*c*), or the like.

Figure 12D:
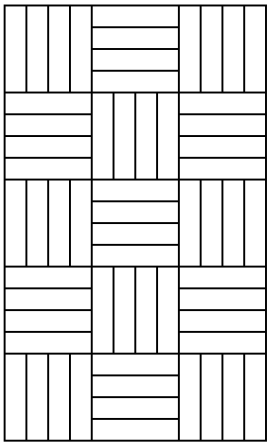
Figure 14B:
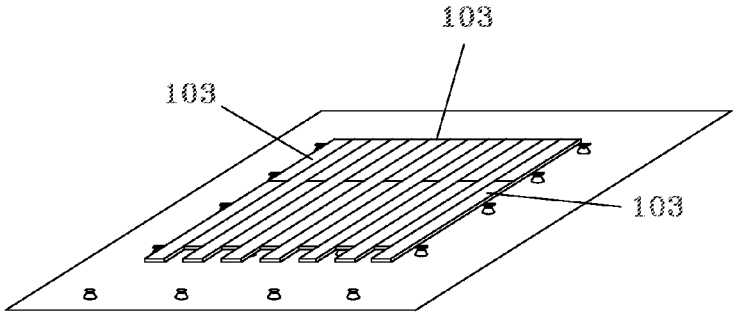
FIGS. 14*a*-14*c* depict known examples of fitted flooring.
Figure 14A:
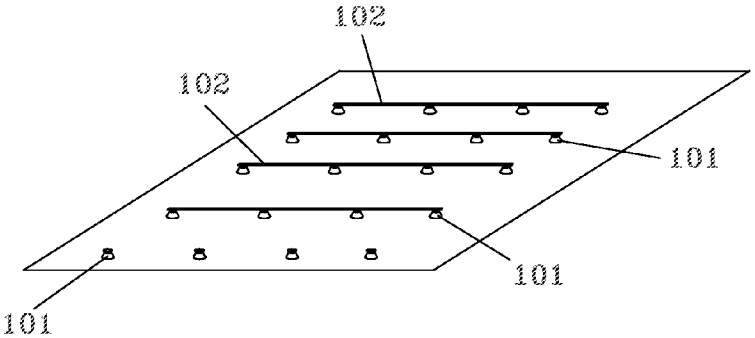
Figure 14C:
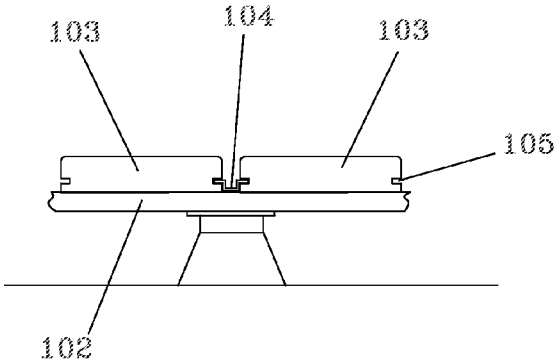

Joining the various bearing plates 2, with the rows 13*a* and 13*b* of teeth 13 alternately arranged in directions perpendicular to one another, enables different patterns to be obtained, such as the square basket pattern (FIG. 12*d*).

Figure 13:
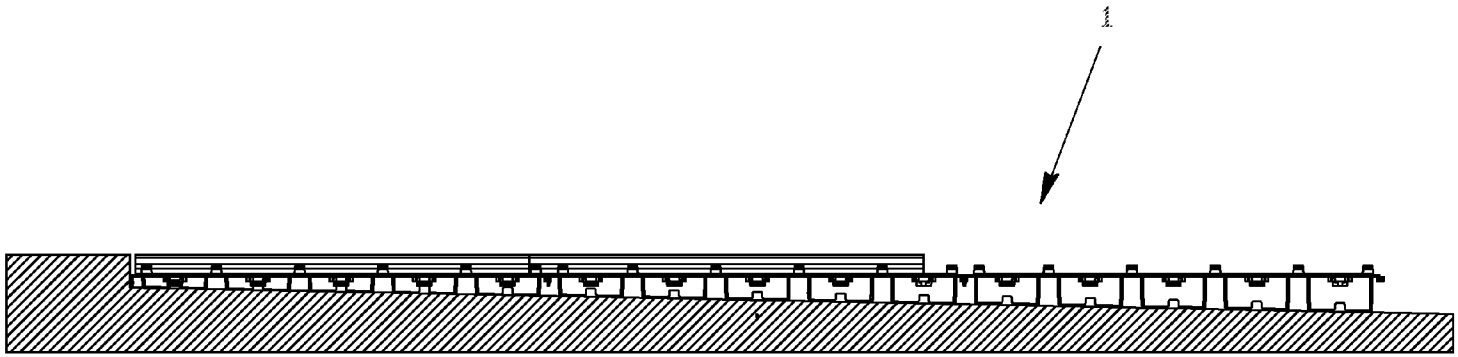
FIG. 13 is a lateral cross-sectional view showing the modular fitted flooring system according to another embodiment.

FIG. 13 shows another embodiment of the present invention.

In detail, said further embodiment involves the bearing plates 2 being complete with supporting elements 7 with a different height.

In particular, the height of said supporting elements increases progressively from one lateral edge towards the opposite lateral edge of the plate, so as to create a supporting surface that slopes at a preset angle in relation to the plane of the plate 4.

This solution enables a perfectly flat flooring surface to be obtained irrespective of the gradient of the subfloor.

This may be useful both when the subfloor has yet to be made, and when it has already been prepared and cannot be altered.

In the former case, the bedding layer for the subfloor can be made slightly sloping (e.g. 0.6-0.7%) to improve water run-off, using bearing plates with a standard gradient (e.g. 0.5%) between this supporting surface and the flooring panel so as to compensate for the slope of the subfloor and keep the floor surface substantially horizontal.

In the latter case, if the existing subfloor has a considerable slope and cannot be altered, the invention allows for special bearing plates to be used with a relative gradient between the supporting surface and the flooring panel that can be customised to restore the flooring to the horizontal plane.

This solution is very useful in the above-described cases and it entails no extra manufacturing costs because it simply involves inserting suitable plugs with the required angulation inside the mould in line with the shaping of the supporting elements 7, without having to make a special mould for each sloping angle required.

The present invention consequently enables the production of a modular fitted flooring system that is quick and easy to install thanks to the modular system of bearing plates and panel hooking means that enable the panels to be fixed in place simply by exerting a pressure, without needing to use particular equipment or specialised personnel.

Thanks to the supporting elements 7 and to the load-bearing elements 14, the panel elements are supported along their whole length, preventing any bending phenomena typical of the known systems.

Another advantage of the present invention lies in that it guarantees a quick and efficient run-off of water draining from the floor surface, and it also enables the panel elements to expand and contract as a result of variations in humidity and temperature thanks to the teeth 13 being made of a flexible material and arranged so as to leave a gap between one panel and the next.

Moreover, thanks to the fact that the bearing plates have a standardised shape and are made by moulding a plastic material, the production costs can be contained while different variants of the bearing plates can be produced with supporting elements characterised by different gradients.

This also makes it possible to limit the number of parts constituting the flooring, meaning a smaller number of items that need to be kept in stock, with a considerable saving in the costs of managing the system.

The above-described modular fitted flooring system may undergo numerous modifications and variants, all coming within the scope of the inventive concept; in addition, all the parts may be substituted by other, technically equivalent components.

The invention claimed is:

1. A modular fitted flooring system, comprising:

a plurality of bearing plates made of plastic material; and a plurality of panel elements designed to be hooked onto said bearing plates;

wherein the bearing plates comprise a flat plate with a lower surface having a plurality of supporting elements that provide a base for resting the flat plate on a subfloor, and an upper surface with hooking means for retaining the panel elements and enabling a rapid hooking of the panels under the effect of vertical pressure, and panel load-bearing elements against which the underside of the panel elements remains pressed by the hooking means when the panel elements are hooked in place to avoid slack, wherein lateral edges of said flat plate have jointing elements for connecting one bearing plate to another bearing plate adjacent thereto, said panel element hooking means are arranged on the upper surface of the panel in rows arranged only in the direction of installation of the panel elements and comprising a plurality of teeth extending from said upper surface of the flat plate, each tooth comprising a supporting stem extending from the upper surface of the panel and integrally attached thereto, and only one coupling clip located at the end of said supporting stem and designed to engage in grooves provided on at least two edges of one of the panel elements, said teeth being arranged on the flat plate so as to leave a gap between one panel element and the next in a direction crosswise to the direction of installation of the panel elements, each panel element being retained by two rows of teeth located along its lateral edges in the direction of installation, the teeth being configured such that when a vertical pressure is exerted onto the panel elements, the vertical pressure causes the stems to bend into the gap and the coupling clips to engage in the grooves by directly contacting groove surfaces each defining a portion of each of the grooves to cause the panel elements to be locked onto the bearing plates.

2. The modular fitted flooring system according to claim 1, wherein said rows of teeth are located respectively along the lateral edges of each panel element.

3. The modular fitted flooring system according to claim 1, wherein said coupling clip has a profile with a substantially trapezoid shape tapering upwards so as to define a sloping wall on which the panel element slides when the panel is inserted.

4. The modular fitted flooring system according to claim 1, wherein said panel element comprises lower edges that are slightly recessed in relation to the lateral edges in the direction of installation.

5. The modular fitted flooring system according to claim 1, wherein said elements for bearing the load of the panel elements comprise a plurality of ribs extending from the upper surface of the plate and lying parallel to one another in the direction of installation of the panel elements.

6. The modular fitted flooring system according to claim 1, further comprising a plurality of through openings on the plate for water run-off from the upper surface of the panel into the space underneath.

7. The modular fitted flooring system according to claim 1, wherein said supporting elements are arranged on the lower surface of the plate so as to create a series of passages, between one supporting element and the next supporting element to allow for water to run off into collection and drainage systems.

8. The modular fitted flooring system according to claim 1, wherein said supporting elements consist of cylindrical surfaces extending from the lower surface of the plate.

9. The modular fitted flooring system according to claim 1, wherein said cylindrical surfaces have an edge on which the cylindrical surfaces rest shaped so as to create a plurality of passages for water run-off into collection and drainage systems.

10. The modular fitted flooring system according to claim 1, wherein said supporting elements may be of a constant height so as to create a supporting surface parallel to the plate.

11. The modular fitted flooring system according to claim 1, wherein said supporting elements are of a height that increases progressively from one lateral edge towards the opposite edge of the plate so as to create a supporting surface that slopes at a given angle in relation to the plate.

12. The modular fitted flooring system according to claim 1, further comprising additional hooking means for the panel elements, said additional hooking means comprising a plurality of teeth extending from the upper surface of the plate and arranged in two rows in the direction of installation of the panel elements and inserted in between the rows of teeth.

13. The modular fitted flooring system according to claim 1, wherein said panel element includes grooves on the underside thereof designed to contain said additional hooking means.

* * * * *